US005378348A

United States Patent [19]

Davis et al.

[11] Patent Number: 5,378,348

[45] Date of Patent: Jan. 3, 1995

[54] DISTILLATE FUEL PRODUCTION FROM FISCHER-TROPSCH WAX

[75] Inventors: Stephen M. Davis; Daniel F. Ryan, both of Baton Rouge, La.

[73] Assignee: Exxon Research and Engineering Company, Florham Park, N.J.

[21] Appl. No.: 96,129

[22] Filed: Jul. 22, 1993

[51] Int. Cl.[6] ..... C10G 25/00; C10G 35/04; C10G 7/00

[52] U.S. Cl. ..... 208/27; 208/64; 208/66; 208/92; 208/950

[58] Field of Search ..... 208/27, 64, 66, 92, 208/950

[56] References Cited

U.S. PATENT DOCUMENTS

| | | | |
|---|---|---|---|
| 4,125,566 | 11/1978 | Trin Dinh et al. | 208/93 |
| 4,919,786 | 4/1990 | Hamner et al. | 208/27 |
| 4,943,672 | 7/1990 | Hamner et al. | 585/737 |
| 5,059,299 | 10/1991 | Cody et al. | 208/27 |

*Primary Examiner*—Anthony Mc Farlane
*Assistant Examiner*—Nhat D. Phan
*Attorney, Agent, or Firm*—Jay Simon

[57] ABSTRACT

Distillate fuels with excellent cold flow properties are produced from waxy Fischer-Tropsch products by separating the product into a heavier and a lighter fraction, isomerizing the heavier fraction, hydrotreating and isomerizing the lighter fraction, and recovering products in jet and diesel fuel ranges.

11 Claims, 1 Drawing Sheet

DISTILLATE FUEL PRODUCTION FROM FISCHER-TROPSCH WAX

FIELD OF THE INVENTION

This invention relates to the production of middle distillates useful as diesel or jet fuels and having excellent low temperature properties. More particularly, this invention relates to the production of distillate fuels from a waxy hydrocarbon produced by the reaction of CO and hydrogen, the Fischer-Tropsch hydrocarbon synthesis process. Still more particularly, this invention relates to a process whereby the wax feed is separated into at least two fractions, a heavier fraction which is hydroisomerized without intermediate hydrotreatment, and at least one lighter fraction which is hydrotreated prior to hydroisomerization.

BACKGROUND OF THE INVENTION

The waxy product of a hydrocarbon synthesis product, particularly the product from a cobalt based catalyst process, contains a high proportion of normal paraffins. Nevertheless, the products from hydrocarbon synthesis must be useful in a wide variety of applications, just as are the products from naturally occurring petroleum. Indeed, the products must be fungible and the application must not be affected by the source of the product. Waxy products provide notoriously poor cold flow properties making such products difficult or impossible to use where cold flow properties are vital, e.g., lubes, diesel fuels, jet fuels.

Cold flow properties can be improved by increasing the branching of distillates within the proper boiling range as well as by hydrocracking heavier components. Hydrocracking, however, produces gaseous and light products that tend to reduce the yield of valuable distillates, and there remains a desire for maximizing distillates obtained from Fischer-Tropsch waxes.

SUMMARY OF THE INVENTION

This process tends to increase the yield of distillates, such as kerosene, diesels, and lube base stocks as well as providing excellent cold flow properties that are essential for the utility of these materials. In accordance with this invention, materials useful as diesel and jet fuels or as blending components for diesel and jet fuels are produced from waxy Fischer-Tropsch products by a process comprising: separating (by fractionation) the waxy Fischer-Tropsch product into a heavier fraction boiling above about 500° F. and at least one lighter fraction boiling below about 500° F., for example, a 320°/500° F. fraction but preferably an all remaining liquid, at atmospheric pressure, fraction, i.e., a $C_5$/500° F. fraction.

The heavier fraction is catalytically hydroisomerized, preferably in the absence of intermediate hydrotreating, and produces products with excellent cold flow characteristics that can be used as jet fuels and diesel fuels or as blending components therefor. Preferably this isomerized material produces jet fuels having a freeze point of about −40° F. or lower and diesel fuels having low cloud points, and cetane ratings less than that of the corresponding normal paraffins; thus, indicating increased product branching relative to the waxy paraffin feed.

The lighter fraction, either the 320/500 cut or the $C_5$/500 cut, is first subjected to mild catalytic hydrotreating to remove hetero-atom compounds, such as oxygenates, followed by catalytic hydroisomerization thereby producing materials also useful as diesel and jet fuels or useful as blending components therefor. Optionally, all or a part of each product stream can be combined or blended and used as diesel or jet fuels or further blended for such use.

The catalysts useful in each hydrotreating and hydroisomerization can be selected to improve the qualities of the products.

In one embodiment of this invention, any 700° F.+ materials produced from either hydroisomerization step can be recycled or fed to the hydroisomerization step for the heavier fraction for further conversion and isomerization of the 700° F.+ fraction.

DETAILED DESCRIPTION

Figure 1:
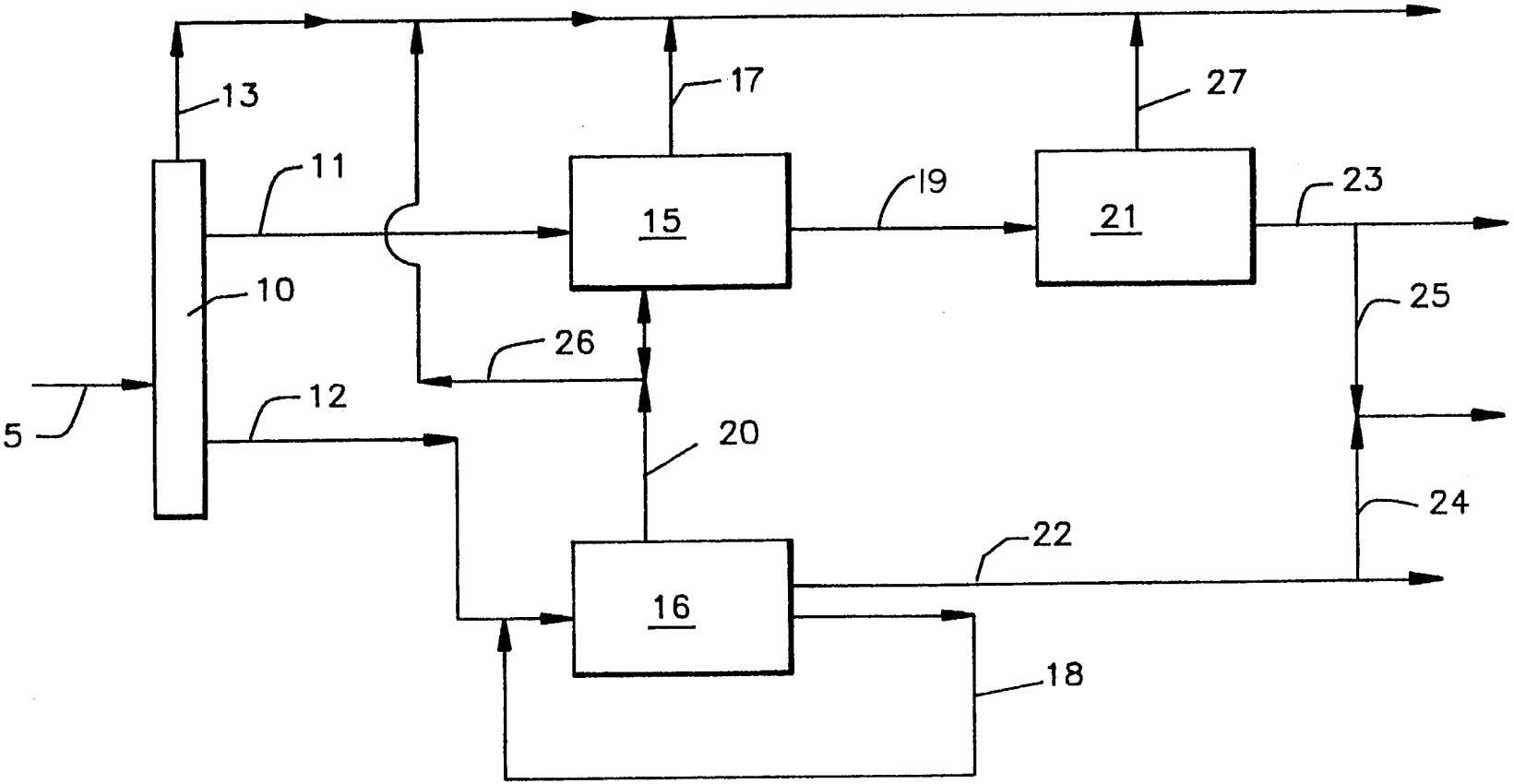
FIG. 1 is a schematic arrangement of the process and its embodiments.

The Fischer-Tropsch process can produce a wide variety of materials depending on catalyst and process conditions. Currently, preferred catalysts include cobalt, ruthenium and iron. Cobalt and ruthenium make primarily paraffinic products, cobalt tending towards a heavier product slate, e.g., containing $C_{20+}$, while ruthenium tends to produce more distillate type paraffins, e.g., $C_5$–$C_{20}$. Regardless of the catalyst or conditions employed, however, the high proportion of normal paraffins in the product must be converted into more useable products, such as transportation fuels. This conversion is accomplished primarily by hydrogen treatments involving hydrotreating, hydroisomerization, and hydrocracking. Nevertheless, the feed stock for this invention can be described as a waxy Fischer-Tropsch product, and this product can contain $C_{5+}$ materials, preferably $C_{10+}$, more preferably $C_{20+}$ materials, a substantial portion of which are normal paraffins. A typical product slate is shown below, which can vary by ±10% for each fraction.

TABLE A

| Typical product slate from F/T process liquids: | |
|---|---|
| | Wt % |
| IBP–320° F. | 13 |
| 320–500° F. | 23 |
| 500–700° F. | 19 |
| 700–1050° F. | 34 |
| 1050° F.+ | 11 |
| | 100 |

The feed stock is separated, usually by fractionation into a heavier fraction and at least one lighter fraction. The heavier fraction, preferably a 500° F.+ fraction is substantially free of 500° F− materials. Preferably, the heavier fraction contains less than about 3 wt % 500° F.−. We have found that hydrotreatment of this fraction, while allowing for increased conversion upon hydroisomerization, does not provide the excellent cold flow properties that can be obtained by hydroisomerization of an untreated fraction. Consequently, the heavier fraction is preferably subjected to catalytic hydroisomerization in the absence of any prior hydrotreating step. In other words the heavier fraction is not subjected to any chemical or catalytic treatment prior to hydroisomerization.

Hydroisomerization is a well known process and its conditions can vary widely. For example, Table B below lists some broad and preferred conditions for this step.

TABLE B

| CONDITION | BROAD RANGE | PREFERRED RANGE |
|---|---|---|
| temperature, °F. | 300–800 | 650–750 |
| pressure, psig | 0–2500 | 500–1200 |
| hydrogen treat rate, SCF/B | 500–5000 | 2000–4000 |
| hydrogen consumption rate, SCF/B | 50–500 | 100–300 |

While virtually any catalyst may be satisfactory for this step, some catalysts perform better than others and are preferred. For example, catalysts containing a supported Group VIII noble metal, e.g., platinum or palladium, are useful as are catalysts containing one or more Group VIII base metals, e.g., nickel, cobalt, which may or may not also include a Group VI metal, e.g., molybdenum. The support for the metals can be any refractory oxide or zeolite or mixtures thereof. Preferred supports include silica, alumina, titania, zirconia, vanadia and other Group III, IV, VA or VI oxides, as well as Y sieves, such as ultrastable Y sieves. Preferred supports include alumina and silica-alumina where the silica concentration of the bulk support is less than about 50 wt %, preferably less than about 35 wt %. More preferred supports are those described in U.S. Pat. No. 5,187,138 incorporated herein by reference. Briefly, the catalysts described therein contain one or more Group VIII metals on alumina or silica-alumina supports where the surface of the support is modified by addition of a silica precursor, e.g., $Si(OC_2H_5)_4$. Silica addition is at least 0.5 wt % preferably at least 2 wt %, more preferably about 2–25 wt %.

One factor to be kept in mind in hydroisomerization processes is that increasing conversion tends to increase cracking with resultant higher yields of gases and lower yields of distillate fuels. Consequently, conversion is usually maintained at about 35–80% of feed hydrocarbons boiling above 700° F. converted to hydrocarbons boiling below 700° F.

The cold flow properties of the resulting jet fuel (320°/500° F.) fraction and diesel fuel (500°/700° F.) fraction are excellent, making the products useful as blending stocks to make jet and diesel fuels.

At least one lighter fraction boiling below 500° F. is also recovered and treated. The lighter fraction can be a 320°–500° fraction or preferably the entire liquid fraction boiling below 500° F., that is, the $C_5$/500° fraction. In either case the treatment steps are the same. First, the lighter fraction is hydrotreated to remove hetero-atom compounds, usually oxygenates formed in the hydrocarbon synthesis process. Hydrotreating temperatures can range from about 350°–600° F., pressures from about 100–3000 psig and hydrogen consumption rates of about 200–800 SCF/B feed. Catalysts for this step are well known and include any catalyst having a hydrogenation function, e.g., Group VIII noble or non-noble metal or Group VI metals, or combinations thereof, supported on refractory oxides or zeolites, e.g, alumina, silica, silica-alumina; alumina being a preferred support.

Turning to the drawing, hydrogen and CO enter Fischer-Tropsch reactor 10 where the synthesis gas is converted to $C_{5+}$ hydrocarbons. A heavier fraction is recovered in line 12 and hydroisomerized in reactor 16. The useful product, a 320–700 fraction is recovered in line 22 and may be used as diesel or jet fuel or as blending components therefore, after fractionation (not shown). In one embodiment, the 700° F.+ material is recovered from the product in line 18 and recycled to the reactor 16. In another embodiment the light naphtha, e.g., $C_5$/320 fraction is flashed in line 20 and sent to hydrotreater 15 or optionally by line 26 to the overhead line 13 containing $C_5$/320 naphtha for collection and storage.

The light fraction, in line 11 may be a 320/500 fraction or a $C_5$/500 fraction. In the latter case overhead line 13 does not exist, in the former it collects the light naphtha, i.e., the $C_5$/320 fraction. The lighter fraction is hydrotreated in hydrotreater 15 and the resulting light naphtha is flashed in line 17 to line 13. The 320/500 fraction is recovered in line 19 and hydroisomerized in reactor 21. The resulting product in line 23 may be used as jet fuel or as a blending agent therefor, and optionally may be combined via line 25 with product from reactor 16 in line 24. Light naphtha is flashed from reactor 21 and recovered in line 27.

After hydrotreating the lighter fraction, the light naphtha is flashed off and the remaining material is subjected to hydroisomerization. The catalyst can be any catalyst useful in hydroisomerization of light fractions, e.g., 320/500 fractions, and preferably contains a supported Group VIII noble metal. The noble metal catalysts containing platinum or palladium as described in U.S. Pat. No. 5,187,138 are preferred.

TABLE C

| CONDITION | BROAD RANGE | PREFERRED RANGE |
|---|---|---|
| temperature, °F. | 300–800 | 600–750 |
| pressure, psig | 50–2000 | 700–1200 |
| hydrogen treat rate, SCF/B | 500–5000 | 2000–4000 |
| hydrogen consumption rate, SCF/B | 50–500 | 100–300 |

In catalytic hydroisomerization reactions feed cracking should be maintained as low as possible, usually less than 20% cracking, preferably less than 10%, more preferably less than about 5%.

The following examples will serve to illustrate further this invention.

EXAMPLE 1

A series of six catalysts (A–H) was investigated for isomerization of a non-hydrotreated Fischer-Tropsch wax material with an initial boiling point of about 500° F. and an oxygen content of about 0.45 wt %. All of the catalysts were prepared according to conventional procedures using commercially available materials well known in the art. (Catalysts I through N were used in later experiments.) The tests were conducted in a small upflow pilot plant unit at 1000 psig, 0.5 LHSV, with a hydrogen treat gas rate near 3000 SCF/Bbl, and at temperatures of 650° to 750° F. Material balances were collected at a series of increasing temperatures with operation periods of 100 to 250 hours at each condition. The composition of the catalysts is outlined in Table 1. Table 1 also indicates the relative activity of the catalysts expressed as the reaction temperature needed to achieve 40–50% conversion of feed hydrocarbons boiling above 700° F. to hydrocarbons boiling below 700° F. Catalysts described as being surface impregnated with silica were prepared in accordance with U.S. Pat. No. 5,187,138.

TABLE 1

| CATALYST | COMPOSITION | REACTION T (°F.) | 700° F.+ CONVERSION (WT %) |
|---|---|---|---|
| A | 12% Mo-0.5% Ni-3% Co on 10% $SiO_2$—$Al_2O_3$ | 726 | 46 |
| B | 12% Mo-0.5% Ni-3% Co on 20% $SiO_2$—$Al_2O_3$ | 705 | 46 |
| C | 12% Mo-0.5% Ni-3% Co on 27% $SiO_2$—$Al_2O_3$ | 705 | 44 |
| D | 4% surface impregnated silica on A | 708 | 53 |
| E | 8% surface impregnated silica on A | 696 | 44 |
| F | 16% surface impregnated silica on A | 668 | 40 |
| G | 4% surface impregnated silica on 0.6% Pt on 10% $SiO_2$—$Al_2O_3$ | 707 | 39 |
| H | 4% surface impregnated silica on 0.7% Pd on 10% $SiO_2$—$Al_2O_3$ | 716 | 43 |
| I | 0.5% Pd on composite support with 20% $Al_2O_3$ and 80% ultrastable-Y | — | — |
| J | 6% surface impregnated silica on 0.3% Pd on 10% $SiO_2$—$Al_2O_3$ | — | — |
| K | 0.5% Pd on 75% $SiO_2$—$Al_2O_3$ | — | — |
| L | 0.5% Pd on composite support with 80% high silica zeolite Y and 20% $Al_2O_3$ | — | — |
| M | 7.0% F on 0.6% Pt/$Al_2O_3$ | — | — |
| N | 0.5% Pt on ultrastable-Y zeolite | — | — |

Clearly, different catalysts displayed significant differences in wax conversion activity. The most active materials were those produced using a surface silica additive. However, for the purposes of this invention, activity is not a critical factor. More important factors include the selectivity for producing jet fuel and diesel fuel versus gas and naphtha and the quality of the resulting jet fuel and diesel; e.g., these products should approach or meet cold flow property specifications for use as transportation fuels.

Table 2 provides a comparison of product distributions, jet fuel freeze points, diesel pour points, and cetane ratings for operations carried out at 40–50% 700° F.+ conversion. All the catalysts considered in this example showed more-or-less similar boiling range product distributions characterized by high selectivity to 320°/500° F. jet fuel range hydrocarbons with low gas and naphtha make. Other catalysts (not shown) were also examined which did not show such favorable selectivities.

TABLE 2

| CATALYST | 700+ CONV. (%) | PRODUCT YIELDS C1–C4 | C5/320 | 320/500 | 500/700 | 700+ | 320/500 FREEZE POINT (°F.) | 500/700 POUR POINT (°F.) | 500/700 CENTANE |
|---|---|---|---|---|---|---|---|---|---|
| A | 46 | 3.4 | 5.2 | 20.8 | 32.9 | 41.7 | −13 | 27 | 71 |
| B | 46 | 3.5 | 5.7 | 21.8 | 32.4 | 41.1 | −31 | −11 | 68 |
| C | 44 | 1.6 | 5.6 | 20.7 | 31.4 | 43.2 | −21 | −11 | 68 |
| D | 53 | 2.0 | 7.3 | 25.0 | 32.0 | 34.8 | −47 | −6 | 66 |
| E | 44 | 2.4 | 4.7 | 21.1 | 31.8 | 43.4 | −31 | −11 | 68 |
| F | 40 | 1.7 | 4.8 | 21.3 | 27.9 | 46.0 | −31 | −11 | 68 |
| G | 39 | 3.8 | 9.7 | 19.2 | 19.9 | 47.8 | −26 | −17 | 66 |
| H | 43 | 1.4 | 6.4 | 24.9 | 22.7 | 44.8 | −27 | −17 | 69 |

@ 1000 psig/0.5 LHSV/2500–3000 SCF/Bbl-H2

Table 2 shows that only certain catalysts combine high activity and jet/diesel selectivity in achieving cold flow properties. Specifically, Catalyst A was not able to produce jet fuel with acceptable cold flow properties. However, catalysts containing the same metal combination and loadings on silica-alumina supports with 20–30 wt % silica content (B and C) provided acceptable performance. Also, CoNiMo/10% $SiO_2$-$Al_2O_3$ catalysts which were modified by the addition of an additional 4–16 wt % silica as surface impregnated silica (catalysts D–F) also provided good performance. Good performance was also recognized with surface silica modified catalysts containing platinum or palladium (G,H) in place of CoNiMo. These types of catalysts (represented by B–H) produced products of similar overall quality and are strongly preferred for the wax isomerization step for 500° F.+ material.

EXAMPLE 2

Catalyst D (4% $SiO_2$/CoNiMo/10% $SiO_2$-$Al_2O_3$) was tested for 500° F.+ wax conversion activity, selectivity, and product quality under several different sets of processing conditions. In these tests, the catalyst was in the form of 1/20" quadrilobe extrudates in a 200 cc pilot plant reactor. Table 3 summarizes results of these studies which employed the same non-hydrotreated wax feed as in Example 1. Activity was improved with equivalent selectivity and jet fuel quality when the pressure was lowered to 500 psig and space velocity was increased to 1.0 LHSV. However, when the wax feed rate was increased to 3.0 LHSV and the temperature also increased, the selectivity pattern changed dramatically, e.g., the yield of jet fuel was lowered in favor of gas and naphtha production, and the quality of the jet fuel was also impaired as reflected by an increased freeze point. The detailed reasons for this change in selectivity are not fully understood, although pore diffusion limitations are believed to be a primary factor contributing to the inferior performance at 3 LHSV.

TABLE 3

| CONDITIONS | RELATIVE RATE CONSTANT FOR 700° F.+ CONVERSION | SELECTIVITY |
|---|---|---|
| 700° F./ 1000 psig/0.5 LHSV | 1.0-Base | Base |
| 700° F./ 500 psig/1.0 LHSV | 2.0 | Base |
| 725° F./ 1000 psig/3.0 LHSV | 4-5 | −8% jet/diesel; +7% gas/naphtha |

EXAMPLE 3

Several tests were also carried out using a 550° F.+ Fischer-Tropsch wax which was hydrotreated to remove small levels of oxygen-containing hydrocarbons (alcohols, aldehydes, etc.) prior to isomerization. Hydrotreating was carried out at 635° F., 1000 psig, 2500 scf/Bbl $H_2$ treat rate, and at space velocities of 0.5 to 3.0 LHSV using a commercial sulfided $NiMo/Al_2O_3$ catalyst. Wax isomerization and hydrocracking was subsequently carried out using Catalyst B at 1000 psig, 0.5–3.0 LHSV, and 620°–660° F. Results from these tests are compared with single stage isomerization operations in Table 4. The reactivity of the Fischer-Tropsch wax for conversion during isomerization was increased greatly by prehydrotreating. For example, 50% 700° F.+ conversion was achieved near 600° F. with the hydrotreated wax versus a temperature requirement near 700° F. with the non-hydrotreated wax. However, the quality of the jet fuel produced with hydrotreating followed by isomerization was not as good as that achieved with single stage operations. Based on this behavior, wax isomerization is preferably carried out using non-hydrotreated 500° F.+ Fischer-Tropsch product.

TABLE 4

| 500° F.+ Feed | Reaction T (°F.) | 700° F.+ Conversion (%) | Product Properties at 75° F. 320/700° F. | 700° F.+ |
|---|---|---|---|---|
| Non-hydrotreated | 716 | 57 | clear liquid | clear liquid |
| Hydrotreated | 608 | 56 | cloudy, waxy liquid | hard wax |

@ 1000 psig, 0.5 LHSV, 2500 SCF/Bbl

EXAMPLE 4

Tests were also carried out using Fischer-Tropsch wax feeds with variable contents of 500° F.− hydrocarbons. As shown in Table 5 for similar levels of 700° F.+ feed conversion, the quality of the 320°/500° F. jet fuel (judged from freeze point measurements) improved as the 500° F.− content on feed decreased. In order to meet jet fuel freeze point specifications at 700° F.+ conversion levels near 50–60%, the content of 500° F.− hydrocarbons on wax feed is less than about 6%, preferably less than 4 wt %, and most preferably less than 2 wt %.

TABLE 5

| At 50% 700+ F. Conversion to 700− F. Material | |
|---|---|
| Wt % 500° F. in Wax | Freeze Pt. of 320/500° F. Jet Component |
| 5.5 | −33° C. (−27° F.) |
| 1.5 | −45° C. (−49° F.) |

EXAMPLE 5

Catalyst H of Example 1 and catalyst I were evaluated for isomerization of a light oil Fischer-Tropsch product boiling between 100° F. and 500° F. (approximating a $C_5$/500 fraction). The reaction conditions were similar to those described in Example 1. Catalyst I was a commercially available hydrocracking catalyst containing 0.5 wt % Pd dispersed on a particulate support material containing about 80 wt % ultrastable-Y zeolite and 20 wt % alumina. Little or no conversion of this feed could be accomplished with either catalyst for reaction temperatures up to 750° F.

EXAMPLE 6

The same feed employed in Example 4 was subjected to hydrotreating and fractionation before isomerization tests were conducted. Hydrotreating was carried out at 350 psig, 450° F., and 3 LHSV using a 50% $Ni/Al_2O_3$ catalyst. After hydrotreating, the feed was topped to an initial boiling point of about 350° F. prior to isomerization tests. The isomerization tests were carried out at 350–600 psig, 550°–700° F., and 1 LHSV using catalysts J and L described in Table 1. In contrast to Example 4, the hydrotreated distillate feed showed good reactivity for conversion to naphtha and isomerized distillate range hydrocarbons that are suitable for use as diesel and jet fuel blending components. At high levels of 500° F.+ conversion, the 320°/500° F. product produced over catalyst J was suitable for use as jet fuel without further blending. This catalyst contained 0.3 wt % palladium dispersed on a 10% $SiO_2$-$Al_2O_3$ support which was further modified by the addition of 6 wt % surface silica derived from impregnation of $Si(OC_2H_5)_4$. This catalyst displayed a superior selectivity for jet fuel production versus gas and naphtha as compared to the more active catalysts K and L which contained 0.5% palladium dispersed on supports containing 75% $SiO_2$-$Al_2O_3$ and ultrastable-Y zeolite, respectively. Table 6 compares product distributions and jet quality at several conversion levels.

TABLE 6

| HYDROISOMERIZATION OF HYDROTREATED 350/500 F.− T DISTILLATE | | | | | |
|---|---|---|---|---|---|
| CATALYST | T (°F.) | $NC_{10}$+ CONV. | PRODUCT YIELDS (WT %) C1/320 | 320/500 | 320/500° F. FREEZE PT (°F.) |
| Pd/US-Y | 588.7 | 71.6 | 40.64 | 59.36 | −38 |
| Pd/Si-enhanced TN-8 $SiO_2$—$Al_2O_3$ (from U.S. Pat. No. 5,187,138) | 599.8 | 84.1 | 54.63 | 45.37 | −51 |

EXAMPLE 7

Isomerization tests were also carried out with the same hydrotreated 350° F.+ distillate feedstock employed in Example 6 using catalyst K described in Table 1 and a lab catalyst prepared by impregnating 0.5 wt % palladium onto the same 20% $SiO_2$-$Al_2O_3$ support that was used to produce catalyst B.

This catalyst was dried and calcined in air at 450° C. for 3–4 hours prior to use. In this case, the test goal was to maximize the yield of 320°–500° F. boiling range distillate satisfying a freeze point specification of −50° F. Table 7 compares product yields under these conditions of constant product quality. It can be seen that the catalyst produced using the 20 wt % silica support provided improved distillate yield and reduced gas and naphtha make as compared to the catalyst produced using the high (75 wt %) silica content support, although both catalysts provided effective performance.

TABLE 7

| Hydroisomerization of Hydrotreated 350/500° F.− T Distillate | | |
|---|---|---|
| Catalyst | 0.5% Pd/20% $SiO_2$—$Al_2O_3$ | 0.5% Pd/75% $SiO_2$—$Al_2O_3$ |
| Yield (wt %) at −50° F. 320/500° F. Freeze Point | | |
| $C_1$–$C_4$ Gas | 1.8 | 2.6 |
| $C_5$/320° F. | 10.5 | 13.5 |
| 320/500° F. | 82.5 | 77.7 |

TABLE 7-continued

| Hydroisomerization of Hydrotreated 350/500° F.− T Distillate | | |
|---|---|---|
| Catalyst | 0.5% Pd/20% $SiO_2$—$Al_2O_3$ | 0.5% Pd/75% $SiO_2$—$Al_2O_3$ |
| 500° F.+ | 5.4 | 6.5 |

EXAMPLE 8

Isomerization tests were also conducted using a second hydrotreated normal paraffin feedstock containing primarily distillate range hydrocarbons. In this case, six catalysts (A,D,G,H,M,N) were investigated at 1000 psig, 0.5 LHSV, and with temperatures ranging from 400° F. to 700° F. As shown in Table 8, very different activity and selectivity patterns were observed with the different catalysts. Catalysts A and D containing CoNiMo dispersed on silica-alumina supports showed high tendency for C1–C4 gas make. Catalyst N which contained 0.5 wt % platinum on an ultrastable-Y zeolite showed high activity at low temperatures but the products were mostly naphtha range hydrocarbons. Catalyst M containing 0.6% Pt dispersed on a fluorided alumina showed good activity combined with good selectivity for producing isomerized hydrocarbons in the jet fuel boiling range. However, the best selectivities for producing 320°/500° F. hydrocarbons versus gas and naphtha were obtained with noble metal catalysts containing 0.6 wt % Pt or 0.7 wt % Pd dispersed on a 10% $SiO_2$-$Al_2O_3$ support which was further modified by the addition of 4 wt % surface silica derived from impregnation with $Si(OC_2H_5)_4$.

TABLE 8

| CAT-ALYST | RXN T(F) | 500° F.+ CONV (%) | PRODUCT YIELDS (WT %) CH4 | C2/C4 | C5/320° F. | 320/500 F. |
|---|---|---|---|---|---|---|
| A | 658 | 78 | 4.1 | 1.6 | 8.7 | 69 |
| | 674 | 93 | 9.1 | 3.1 | 14.7 | 54 |
| D | 656 | 80 | 2.1 | 1.4 | 6.4 | 77 |
| | 674 | 92 | 4.7 | 2.5 | 14.4 | 62 |
| G | 656 | 78 | 0.02 | 0.65 | 4.9 | 84 |
| | 672 | 90 | 0.04 | 1.6 | 11.1 | 77 |
| H | 656 | 72 | 0.01 | 0.61 | 3.9 | 84 |

TABLE 8-continued

| CAT-ALYST | RXN T(F) | 500° F.+ CONV (%) | PRODUCT YIELDS (WT %) CH4 | C2/C4 | C5/320° F. | 320/500 F. |
|---|---|---|---|---|---|---|
| | 671 | 88 | 0.01 | 1.3 | 9.0 | 80 |
| M | 590 | 58 | 0.01 | 0.85 | 4.1 | 79 |
| N | 400 | 52 | 0.01 | 7.6 | 25.4 | 47 |

@ 1000 psig/0.5 LHSV/3000 SCF/Bbl-$H_2$; 32% 550° F.+ on feed

What is claimed is:

1. A process for producing middle distillate transportation fuel components from the waxy product of a hydrocarbon synthesis process which comprises:
   (a) separating the waxy product into a heavier fraction and at least one lighter fraction;
   (b) catalytically isomerizing the heavier fraction in the presence of hydrogen and recovering products with improved cold flow properties;
   (c) catalytically hydrotreating the lighter fraction and removing hetero atom compounds therefrom;
   (d) catalytically isomerizing the product of step (c) to produce jet fuel component having a freeze point of −30° F. or lower.

2. The process of claim 1 wherein the heavier fraction boils above about 500° F.

3. The process of claim 1 wherein the lighter fraction boils in the range $C_5$–500° F.

4. The process of claim 3 wherein the lighter fraction boils in the range 320°–500° F.

5. The process of claim 2 wherein the heavier fraction is substantially free of materials boiling below 500° F.

6. The process of claim 5 wherein the heavier fraction contains less than about 3% hydrocarbons boiling below 500° F.

7. The process of claim 2 wherein at least a portion of the product of step (b) is combined with at least a portion of the product of step (d).

8. The process of claim 7 wherein at least a portion of the product boiling in the range 320°–500° F. from step (b) is combined with at least a portion of the product boiling in the range 320°–500° F. of step (d).

9. The process of claim 1 wherein the product recovered from step (b) boils in the range 320°–700° F.

10. The process of claim 9 wherein the recovered product boils in the range 500°–700° F.

11. The process of claim 1 wherein the product recovered from step (d) boils in the range 320°–500° F.

* * * * *